US009772638B2

(12) United States Patent
Zeng

(10) Patent No.: US 9,772,638 B2
(45) Date of Patent: Sep. 26, 2017

(54) TWO-STAGE ERROR AMPLIFIER WITH NESTED-COMPENSATION FOR LDO WITH SINK AND SOURCE ABILITY

(71) Applicant: STMicroelectronics (Shenzhen) R&D Co. Ltd, Shenzhen (CN)

(72) Inventor: Ni Zeng, Shenzhen (CN)

(73) Assignee: STMicroelectronics (Shenzhen) R&D Co. Ltd, Shenzhen (CN)

( * ) Notice: Subject to any disclaimer, the term of this patent is extended or adjusted under 35 U.S.C. 154(b) by 156 days.

(21) Appl. No.: 14/592,040

(22) Filed: Jan. 8, 2015

(65) Prior Publication Data

US 2016/0187902 A1 Jun. 30, 2016

(30) Foreign Application Priority Data

Dec. 29, 2014 (CN) ..... 2014 1 0836042

(51) Int. Cl.
*G05F 1/575* (2006.01)

(52) U.S. Cl.
CPC ..... *G05F 1/575* (2013.01)

(58) Field of Classification Search
CPC ..... G05F 1/575; G03F 1/00
USPC ..... 323/280
See application file for complete search history.

(56) References Cited

U.S. PATENT DOCUMENTS 4,587,491 A * 5/1986 Koterasawa ..... H03F 1/3217 330/268
6,437,638 B1 * 8/2002 Coles ..... G05F 1/618 327/540
6,501,334 B1 * 12/2002 Corsi ..... H03F 3/3076 330/263
7,342,387 B1 * 3/2008 Li ..... G05F 1/575 323/271
8,324,876 B1 * 12/2012 Le ..... G05F 1/575 323/260
9,172,354 B2 * 10/2015 Ciubotaru ..... H03H 11/0405
2004/0021518 A1 * 2/2004 Wrathall ..... H02M 3/156 330/253
2009/0128104 A1 * 5/2009 Mandal ..... G05F 1/575 323/273

(Continued)

OTHER PUBLICATIONS

Search report from EIC 2800 STIC searcher Benjamin Martin.*
Received STIC search report from EIC 2800 searcher Benjamin Martin on May 24, 2017.*

*Primary Examiner* — Timothy J Dole
*Assistant Examiner* — Htet Z Kyaw
(74) *Attorney, Agent, or Firm* — Gardere Wynne Sewell LLP

(57) ABSTRACT

A low dropout amplifier may include an error amplifier having first and second inputs coupled to a reference signal and a feedback signal, respectively. The error amplifier may be configured to generate first and second error signals at first and second outputs, respectively, with the first and second error signals based upon a difference between the reference signal and the feedback signal. A sink stage may be coupled to the first output and configured to generate a sink current based upon the first error signal. A source stage may be coupled to the second output and configured to generate a source current based upon the second error signal. An output node may be coupled to receive the sink and source currents.

21 Claims, 3 Drawing Sheets

(56) References Cited

U.S. PATENT DOCUMENTS

| | | | | |
|---|---|---|---|---|
| 2010/0148738 | A1* | 6/2010 | Schiff | H02M 3/1584<br>323/282 |
| 2011/0095823 | A1* | 4/2011 | Gilbert | H03F 1/0277<br>330/254 |
| 2011/0199366 | A1* | 8/2011 | Tsuchi | G09G 3/3688<br>345/212 |
| 2013/0113446 | A1* | 5/2013 | De Haas | G05F 1/613<br>323/274 |
| 2014/0062594 | A1* | 3/2014 | Sbuell | H03F 3/3044<br>330/253 |
| 2016/0124448 | A1* | 5/2016 | Murukumpet | G05F 1/575<br>323/268 |
| 2016/0179115 | A1* | 6/2016 | Kronmueller | G05F 1/575<br>323/280 |

* cited by examiner

TWO-STAGE ERROR AMPLIFIER WITH NESTED-COMPENSATION FOR LDO WITH SINK AND SOURCE ABILITY

PRIORITY CLAIM

This application claims priority from Chinese Application for Patent No. 201410836042.9 filed Dec. 29, 2014, the disclosure of which is incorporated by reference.

FIELD OF THE DISCLOSURE

This disclosure is related to the field of amplifiers, and, more particularly, to the field of low dropout amplifiers that contain error amplifiers.

BACKGROUND

Handheld battery powered electronic devices such as tablets and smartphones have been in wide use in recent years, with usage rates that are ever increasing, and with additional functionality being added on a regular basis.

A common type of voltage regulator used in such electronic devices is known as a low dropout (LDO) regulator, which can operate with a small input to output differential voltage, and which provides a high degree of efficiency and heat dissipation. A typical LDO regulator includes an error amplifier that controls a field effect transistor (FET) to cause the FET to sink or source current from or to an output node. One input of the error amplifier receives a feedback signal, while the other receives a reference voltage. The error amplifier controls the power FET so as to maintain a constant output voltage.

Such voltage regulators may be used to power various components of the electronic devices, such as systems on a chip and analog to digital converters. For certain such components, it may be desirable for a LDO regulator to be able to both sink and source current from and to an output node to produce a high degree of accuracy of signal output to the output node. In addition, it is desirable for the error amplifier to have the DC characteristics of low power requirements and a low offset, and to have the AC characteristic of high gain. Therefore, further developments in this area are desirable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One aspect is directed to a low dropout amplifier. The low dropout amplifier may include an error amplifier having first and second inputs coupled to a reference signal and a feedback signal, respectively. The error amplifier may be configured to generate first and second error signals at first and second outputs, respectively, with the first and second error signals based upon a difference between the reference signal and the feedback signal. A sink stage may be coupled to the first output and configured to generate a sink current based upon the first error signal. A source stage may be coupled to the second output and configured to generate a source current based upon the second error signal. An output node may be coupled to receive the sink and source currents.

Another aspect is directed to an error amplifier. The error amplifies may include a differential input stage including a first input coupled to receive a first signal, a second input coupled to receive a second signal, and a tail. The differential input stage may be configured to generate a comparison signal based upon a difference between the first signal and the second signal. At least one gain stage may be coupled to the differential input stage and may be configured to amplify the comparison signal. A differential output stage may have first and second outputs, and may be configured to generate first and second error signals at the first and second outputs based upon the comparison signal. The differential output stage may have first and second voltage drop circuits. The differential output stage may also have a first output stage transistor with a first conduction terminal coupled to the tail and to the first output, a second conduction terminal coupled to the at least one gain stage and to the second output, and a control terminal coupled to the first voltage drop circuit. The differential output stage may further include a second output stage transistor having a first conduction terminal coupled to the tail and to the first output, a second conduction terminal coupled to the at least one gain stage and to the second output, and a control terminal coupled to the second voltage drop circuit.

DETAILED DESCRIPTION

Figure 1:
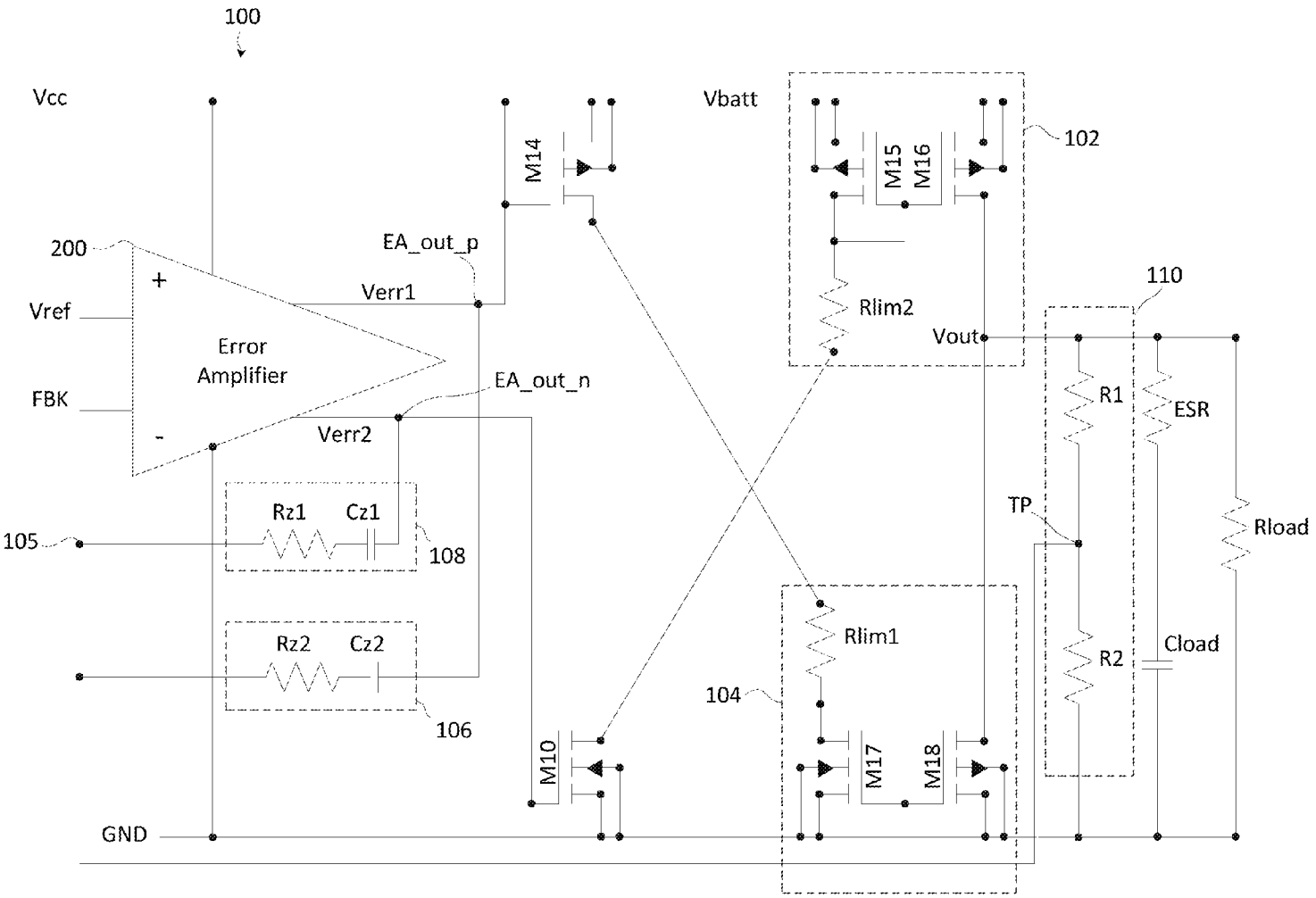
FIG. 1 is a schematic block diagram of a low dropout amplifier in accordance with this disclosure.

One or more embodiments of the present disclosure will be described below. These described embodiments are only examples of the presently disclosed techniques. Additionally, in an effort to provide a concise description, all features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. When referring to transistors, it should be noted that the terms "first conduction terminal" and "second conduction terminal" do not refer to structure or biasing, and are instead merely labels. "First conduction terminal" is used to denote the conduction terminal of a transistor that is closest to the top of the page of the drawing figure on which it appears, while "second conduction terminal" is used to denote the conduction terminal of a transistor that is closest to the bottom of the page of the drawing figure on which it appears. The terms "first conduction terminal" and "second conduction terminal" may each be referring to a source or drain, and this need not be consistent between transistors. For example, the "first conduction terminal" of one transistor may be a source, while the "first conduction terminal" of another transistor may be a drain.

Referring initially to FIG. 1, a voltage regulator 100 for an electronic device is now described. The electronic device may be a tablet, smartphone, smart watch, or any suitable device, and may be powered by a battery (not shown) in some applications. The voltage regulator 100 may be configured as a low dropout regulator, and has the capability to both sink and source current.

The voltage regulator 100 includes an error amplifier 200 coupled between a first power supply Vcc and ground GND. The error amplifier 200 has first and second inputs coupled to a reference signal Vref and a feedback signal FBK, respectively. The reference signal Vref is temperature independent, and may be generated by a bandgap generator (not shown), for example. The feedback signal FBK is provided from a feedback node 105 to which first, second, and third feedback networks 106, 108, and 110 are coupled.

The error amplifier 200 generates first and second differential error signals Verr1, Verr2 at its respective first and second outputs, EA_out_p, EA_out_n and these error signals are based upon a difference between the reference signal Vref and the feedback signal FBK. The first feedback network 106 is coupled between the first output of the error amplifier 200 and the feedback node 105, and is comprised of a capacitor Cz2 and a resistor Rz2 in series. Similarly, the second feedback network 108 is coupled between the second output of the error amplifier 200 and the feedback node 105, and is comprised of a capacitor Cz1 and a resistor Rz1 in series. The third feedback network 110 is coupled between an output node Vout and the feedback node 105. The feedback signal BNK is coupled to the top node TP of network 110.

A load, represented as Rload, is coupled between the output node Vout and ground GND. The third feedback network 110 is, as stated above, coupled between the output node Vout and the feedback node 105, and in parallel with the load Rload. The third feedback network 110 includes first and second resistors R1, R2 in series. A load capacitor Cload and a resistor ESR representing its equivalent series resistance are coupled in series with each other, and in parallel with the load Rload and the third feedback network 110.

The voltage regulator 100 includes a first transistor M14 and a second transistor M10. The first transistor M14 is controlled by the first error signal Verr1, and generates a first current. A sink stage 104 is coupled to the first transistor M14 to receive the first current and mirror the first current to generate a sink current applied to the output node Vout. The second transistor M10 is controlled by the second error signal Verr2, and generates a second current. A source stage 102 is coupled to the second transistor M10 to receive the second current and mirror the second current to generate a source current applied to the output node Vout.

The source stage 102 outputs the source current based upon the feedback signal FBK indicating that the current through the load Rload is within a threshold of, or greater than, zero, and the source stage 102 turns off if the feedback signal FBK indicates that the current through the load Rload is less than zero. The sink stage 104 draws the sink current based upon the feedback signal FBK indicating that a current through the load Rload is within a threshold of, or less than, zero. Likewise, the sink stage 104 turns off if the feedback signal FBK indicates that the current through the load Rload is greater than zero.

The first transistor M14 has a first conduction terminal and body terminal each coupled to the first power source Vcc, a second conduction terminal coupled to the sink stage 104, and a control terminal coupled to the first output of the error amplifier 200 to receive the first error signal Verr1.

The sink stage 104 includes transistors M17, M18 configured as a current mirror to pass the first current to the second conduction terminal of the first transistor M14, and to draw the first current from the output node Vout. A limiting resistor Rlim1 (which limits the first current) is coupled in series between the second conduction terminal of the first transistor M14 and the current mirror formed by the transistors M17, M18.

The transistor M17 has a first conduction terminal coupled to the limiting resistor Rlim1, a second conduction terminal and body terminal each coupled to ground GND, and a control terminal coupled to the first conduction terminal. The transistor M18 has a first conduction terminal coupled to the output node Vout, a second conduction terminal and body terminal each coupled to ground GND, and a control terminal coupled to the control terminal of the transistor M17.

In more detail, the second transistor M10 has a first conduction terminal coupled to the source stage 102, a second conduction terminal and a body terminal each coupled to ground GND, and a control terminal coupled to the second output of the error amplifier 200 to receive the second error signal Verr2.

The source stage 102 includes transistors M15, M16 configured as a current mirror to receive the second current from the first conduction terminal of the second transistor M10, and to mirror the second current to the output node Vout. A limiting resistor Rlim2 (which limits the second current) is coupled in series between the first conduction terminal of the second transistor M10 and the current mirror formed by the transistors M15, M16.

The transistor M15 has a first conduction terminal and body terminal each coupled to the second power source Vbatt, a second conduction terminal coupled to the limiting resistor Rlim2 receive the second current, and a control terminal coupled to the second conduction terminal. The transistor M16 has a first conduction terminal and body terminal each coupled to the second power source Vbatt, a second conduction terminal coupled to the output node Vout, and a control terminal coupled to the control terminal of the transistor M15.

Figure 2:
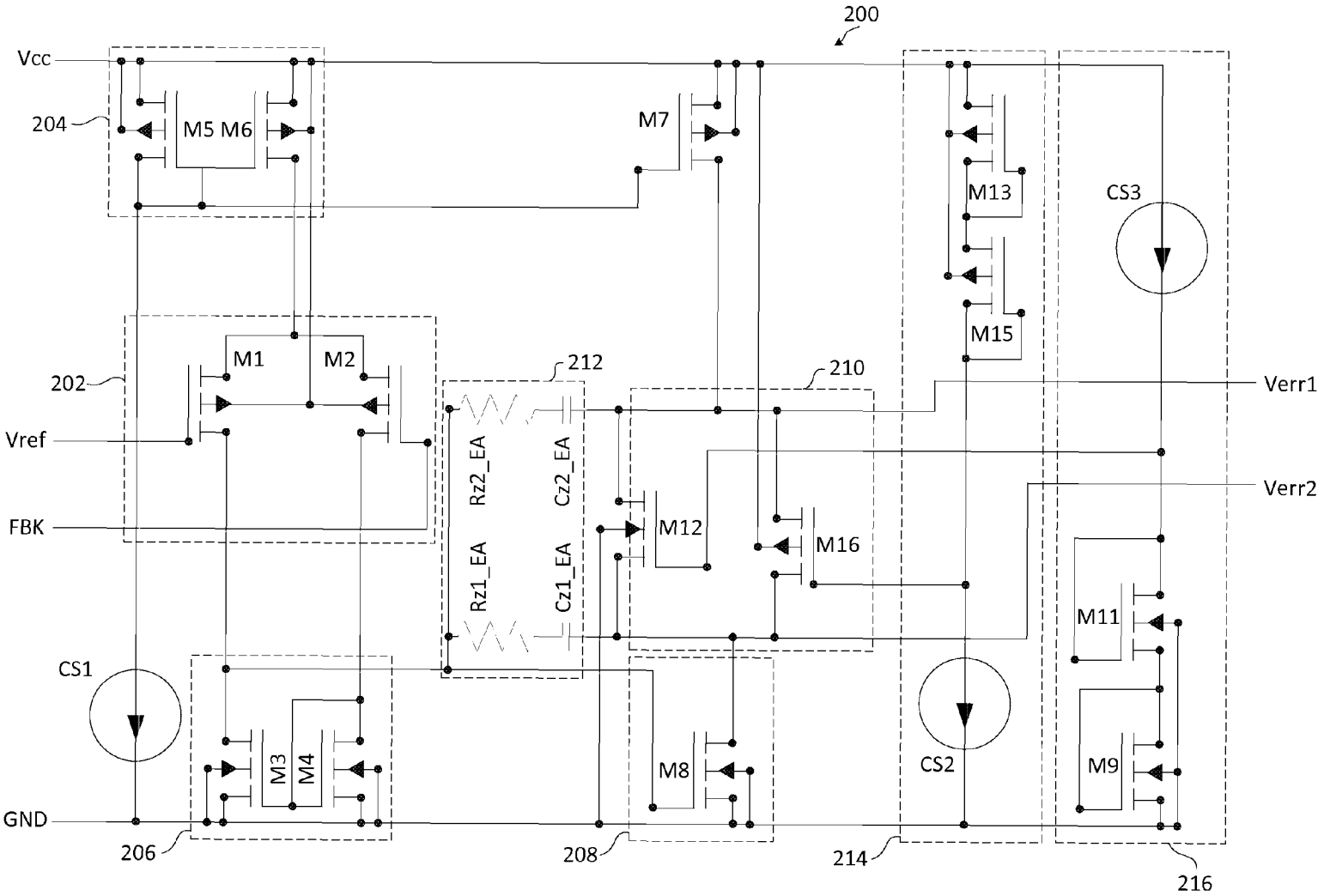
FIG. 2 is a schematic block diagram of the error amplifier of FIG. 1.

With reference to FIG. 2, details of the error amplifier 200 are now given. The error amplifier 200 includes a differential input stage 202 that includes the first and second inputs, which as stated above, receive the reference voltage Vref and the feedback signal FBK, respectively. The differential input stage 202 generates a comparison signal based upon a difference between the reference voltage Vref and the feedback signal FBK. A tail 204 is coupled to the differential input stage 202, and mirrors a constant current from a current source CS1 to the differential input stage 202, and to a differential output stage 210, which will be described below. A first gain stage 206 or active load circuit is coupled to the differential input stage 202, and amplifies the comparison signal. A second gain stage 208 is coupled to the first gain stage 206, and further amplifies the comparison signal.

A differential output stage 210 is coupled to the second gain stage 208, and generates and outputs the first and second error signals Verr1, Verr2 on the first and second outputs EA_out_p, EA_out_n, respectively, based upon the amplified comparison signal. A compensation stage 212 is coupled between the second gain stage 208 and the differential output stage 210, and compensates the amplified comparison signal as will be understood by those of skill in the art.

In more detail, the differential input stage 202 comprises transistors M1, M2 having their first conduction terminals and their body terminals coupled to each other. The body terminals of the transistors M1, M2 are also coupled to the first power source Vcc. The second conduction terminals of the transistors M1, M2 are respectively coupled to the first conduction terminals of transistors M3, M4 that make up the first gain stage 206, as will be explained below. The control terminals of the transistors M1, M2 are respectively coupled to the reference voltage Vref and the feedback signal FBK.

The first gain stage 206 or active load stage includes transistors M3, M4 having first conduction terminals respectively coupled to the second conduction terminals of the transistors M1, M2. The transistors M3, M4 also have second conduction terminals and body terminals each coupled to ground GND, and control terminals coupled to each other and to the first conduction terminal of the transistor M4.

The second gain stage 208 is comprised of a transistor M8. The transistor M8 has a first conduction terminal coupled to the differential output stage 210, a second conduction terminal and body terminal each coupled to ground GND, and a control terminal coupled to the first conduction terminal of the transistor M3.

The tail 204 is comprised of transistors M5, M6 having first conduction terminals and body terminals each coupled to the first power source Vcc, and control terminals coupled to each other. The transistor M5 has a second conduction terminal coupled to the control terminals of the transistors M5, M6, as well as to the current source CS1. The transistor M6 has a second conduction terminal coupled to the first conduction terminals of the transistors M1, M2. A transistor M7 has a first conduction terminal and body terminal coupled to the first power source Vcc, a second conduction terminal coupled to the differential output stage 210, and a control terminal coupled to the control terminals of the transistors M5, M6.

The differential output stage 210 includes transistors M12, M16 having first conduction terminals coupled to the second conduction terminal of the transistor M7 to receive the constant current therefrom, and second conduction terminals coupled to the first conduction terminal of the transistor M8. The first and second conduction terminals of the transistors M12, M16 are also coupled to the compensation network 212. The body terminal of the transistor M12 is coupled to ground GND, and the body terminal of the transistor M16 is coupled to the first power source Vcc. The control terminal of the transistor M12 is coupled to a second voltage drop circuit 216, and the control terminal of the transistor M16 is coupled to a first voltage drop circuit 214.

The first voltage drop circuit 214 includes a pair of diode coupled transistors M13, M15 coupled in series with a second current source CS2 to have a constant current pulled therethrough. The second voltage drop circuit 216 includes a pair of diode coupled transistors M11, M9 coupled in series with a third current source CS3 to receive a constant current therefrom.

The differential output stage 210 includes the first output to output the first error signal Verr1, and the first output is coupled to the first conduction terminals of the transistors M12, M16. The differential output stage 210 also includes the second output to output the second error signal Verr2, and the second output is coupled to the second conduction terminals of the transistors M12, M16.

Figure 3:
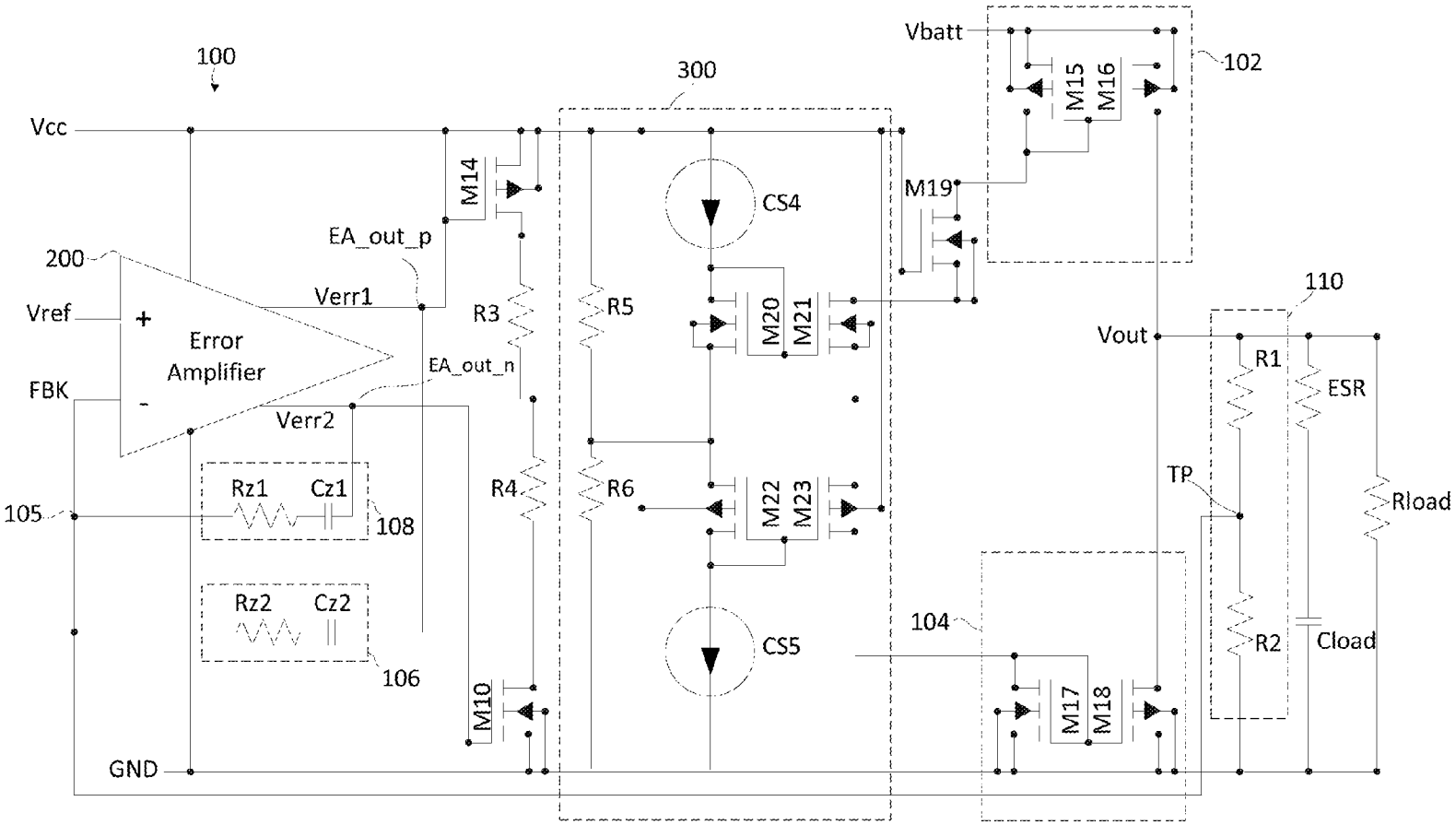
FIG. 3 is a schematic block diagram of a modification of the low dropout amplifier of FIG. 1 to include an amplifier stage between the sink and source transistors and the sink and source current mirrors.

As now described with reference to FIG. 3, in some applications, an amplifier stage 300 may be coupled between the first and second transistors M14, M10 and the sink and source current mirrors formed by transistors M17, M18 and M15, M16. This amplifier stage 300 may help reduce the shoot through current through the transistors M16, M18. As shown in FIG. 3, the amplifier stage is a class AB amplifier as will be understood by those skilled in the art.

Here, a pair of resistors R3, R4 are coupled in series between the second conduction terminal of the first transistor M14 and the first conduction terminal of the second transistor M10. The amplifier stage 300 includes a pair of resistors R5, R6 coupled in series between the first power source Vcc and ground GND. A transistor M20 has a first conduction terminal coupled to a fourth current source CS4, a second conduction terminal coupled to a first conduction terminal of a transistor M22, a control terminal coupled to its first conduction terminal and to a control terminal of a transistor M21, and a body terminal coupled to its second conduction terminal.

The transistor M22 has its first conduction terminal coupled to the second conduction terminal of the transistor M20, a second conduction terminal coupled to a fifth current source CS5, a control terminal coupled to its second conduction terminal as well as to a control terminal of a transistor M23, and a body terminal coupled to the first power source Vcc. The transistor M21 has a first conduction terminal coupled to the second conduction terminal of a transistor M19, as will be explained below, a second conduction terminal coupled to the first conduction terminal of the transistor M23, a control terminal coupled to the control terminal of the transistor M20, and a body terminal coupled to its second conduction terminal. The transistor M23 has a first conduction terminal coupled to the second conduction terminal of the transistor M21, a second conduction terminal coupled to the sink stage 104, a control terminal coupled to the control terminal of the transistor M22, and a body terminal coupled to the first power source Vcc.

The second conduction terminal of the transistor M20 and the first conduction terminal of the transistor M22 are coupled to a node between the resistors R5, R6. The second conduction terminal of the transistor M21 and the first conduction terminal of the transistor M23 are coupled to a node between the resistors R3, R4.

Referring back to FIGS. 1-2, calculation of AC parameters of the electronic device 100 will now be described. When the source stage 102 is on and the sink stage 104 is off, the loop gain can be calculated as follows:

$$A_{EA(EA_out_n)} \approx g_{M1}(r_{M1}\|r_{M3})g_{M8}r_{M8} \tag{1}$$

$$\text{Gain(loop)} \approx A_{EA(EA_out_n)}g_{M10}K\frac{R_2}{R_1+R_2}\frac{1+sR_{Z1}C_{Z1}}{1+sA_{EA(EA_out-n)}\frac{R_1R_2C_{Z1}}{R_1+R_2}}\frac{R_{load}}{1+sC_{load}R_{load}} \tag{2}$$

When both the source stage 102 and the sink stage 104 are on, loop gain can be calculated as follows:

$$r_{EA_out_n} = \left\{\frac{r_{M12}\|r_{M16} + r_{M7}[g_{M16}(r_{M12}\|r_{M16})+1]}{g_{M12}(r_{M12}\|r_{M16})+1}\right\}\|r_{M8} \tag{3}$$

-continued $$A_{EA(EA_out_n)} = g_{M1}(r_{M1}\|r_{M3})g_{M8}r_{EA_out_n} \tag{4}$$

$$i_{M12} = i_{M16} \tag{5}$$

$$g_{M16}v_{EA_out_p} = g_{M12}v_{EA_out_n} \tag{6}$$

$$\frac{v_{EA_out_p}}{v_{EA_out_n}} = \frac{g_{M12}}{g_{M16}} \tag{7}$$

$$\text{Gain(loop)} \approx A_{EA(EA_out_n)}\left(g_{M10} + \frac{g_{M12}}{g_{M16}}g_{M14}\right)K\frac{R_2}{R_1+R_2}\frac{1+sR_{Z1}C_{Z1}}{1+sA_{EA(EA_out-n)}\frac{R_1R_2}{R_1+R_2}\left(C_{Z1}+\frac{g_{M12}}{g_{M16}}C_{Z2}\right)}\frac{R_{load}}{1+sC_{load}R_{load}} \tag{8}$$

When the sink stage 104 is on and the source stage 102 is off, the loop gain can be calculated as follows:

$$A_{EA(EA_out_p)} \approx g_{M1}(r_{M1}\|r_{M3})g_{M8}r_{M7} \tag{9}$$

$$\text{Gain(loop)} \approx A_{EA(EA_out_p)}g_{M14}K\frac{R_2}{R_1+R_2}\frac{1+sR_{Z2}C_{Z2}}{1+sA_{EA(EA_out-p)}\frac{R_1R_2C_{Z2}}{R_1+R_2}}\frac{R_{load}}{1+sC_{load}R_{load}} \tag{10}$$

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. A low dropout amplifier, comprising:

an error amplifier having first and second inputs coupled to a reference signal and a feedback signal, respectively, and configured to generate first and second error signals at first and second outputs, respectively, the first and second error signals based upon a difference between the reference signal and the feedback signal;

a sink stage coupled to the first output and configured to generate a sink current based upon the first error signal;

a source stage coupled to the second output and configured to generate a source current based upon the second error signal; and an output node coupled to receive the sink and source currents;

wherein the error amplifier comprises:

an n-channel output stage transistor having a drain coupled to the first output, a source coupled to the second output to permit conduction between the first output and second output in a first direction, and a gate coupled to a second voltage drop circuit; and a p-channel output stage transistor having a source coupled to the first output, a drain coupled to the second output to permit conduction between the first output and second output in a second direction opposite to the first direction, and a gate coupled to a first voltage drop circuit.

2. The low dropout amplifier of claim 1, wherein the sink stage is configured to further generate the sink current based upon the first and second error signals indicating that a current through the load is negative.

3. The low dropout amplifier of claim 1, wherein the source stage is configured to further generate the source current based upon the first and second error signals indicating that a current through the load is positive.

4. The low dropout amplifier of claim 1, wherein the sink stage comprises:

a transistor having a control terminal coupled to the first output to receive the first error signal, a first conduction terminal coupled to a first power supply node, and a second conduction terminal, the transistor configured to generate a current from its second conduction terminal based upon the first error signal;

a sink current mirror coupled to the second conduction terminal of the transistor and the output node, and configured to mirror the current as the sink current applied to the output node.

5. The low dropout amplifier of claim 1, wherein the source stage comprises:

a transistor having a control terminal coupled to the second output to receive the second error signal, a first conduction terminal coupled to a second power supply node, and a second conduction terminal, the transistor configured to generate a current from its second conduction terminal based upon the second error signal;

a source current mirror coupled to the second conduction terminal of the transistor and the output node, and configured to mirror the current to the output node as the source current.

6. The low dropout amplifier of claim 1, further comprising a first feedback network coupled between the first output and the second input, a second feedback network coupled between the second output and the second input, and a third feedback network coupled between the output node and the second input.

7. The low dropout amplifier of claim 1, wherein at least one of the first and second voltage drop circuits comprises a diode coupled transistor coupled in series with a fixed current source.

8. The low dropout amplifier of claim 1, wherein the error amplifier comprises:

a differential input stage including the first input and the second input, the differential input stage having a tail and being configured to generate a comparison signal based upon a difference between the reference signal at the first input and the feedback signal at the second input;

at least one gain stage coupled to an input of the differential input stage and configured to amplify the comparison signal; and a differential output stage coupled to the at least one gain stage and configured to output the first and second error signals based upon the comparison signal.

9. The low dropout amplifier of claim 8, wherein:

the n-channel output stage transistor has its drain coupled to the tail and the first output, its source coupled to the at least one gain stage and the second output to permit conduction between the first output and second output in a first direction, and its gate coupled to a second voltage drop circuit; and the p-channel output stage transistor has its source coupled to the tail and the first output, its drain coupled to the at least one gain stage and the second output to permit conduction between the first output and second output in a second direction opposite to the first direction, and its gate coupled to a first voltage drop circuit.

10. The low dropout amplifier of claim 8, wherein the at least one gain stage comprises a first gain stage coupled to the input of the differential input stage, and a second gain stage coupled to the first gain stage; wherein the differential input stage has a tail; and wherein the differential output stage is coupled between the tail and the second gain stage.

11. An error amplifier, comprising:

a differential input stage including a first input coupled to receive a first signal, a second input coupled to receive a second signal, and a tail, the differential input stage configured to generate a comparison signal based upon a difference between the first signal and the second signal;

at least one gain stage coupled to the differential input stage and configured to amplify the comparison signal;

a differential output stage having first and second outputs, and configured to generate first and second error signals at the first and second outputs based upon the comparison signal, and comprising:

first and second voltage drop circuits, the first voltage drop circuit comprising a diode coupled transistor coupled in series with a fixed current source, a first output stage transistor having a first conduction terminal coupled to the tail and to the first output, a second conduction terminal coupled to the at least one gain stage and to the second output, and a control terminal coupled to the first voltage drop circuit, and a second output stage transistor having a first conduction terminal coupled to the tail and to the first output, a second conduction terminal coupled to the at least one gain stage and to the second output, and a control terminal coupled to the second voltage drop circuit.

12. The error amplifier of claim 11, wherein the at least one gain stage comprises a first gain stage coupled to the differential input stage, and a second gain stage coupled to the first gain stage; wherein the differential input stage has a tail; and wherein the differential output stage is coupled between the tail and the second gain stage.

13. The error amplifier of claim 11, wherein the second voltage drop circuit comprises a diode coupled transistor coupled in series with a fixed current source.

14. A circuit, comprising:

an error amplifier having first and second inputs coupled to a reference signal and a feedback signal, respectively, and first and second outputs generating first and second error signals, the error amplifier comprising:

first and second voltage drop circuits;

first output stage transistor having a first conduction terminal coupled to the first output, a second conduction terminal coupled to the second output, and a control terminal coupled to the first voltage drop circuit and a second output stage transistor having a first conduction terminal coupled to the first output, a second conduction terminal coupled to the second output, and a control terminal coupled to the second voltage drop circuit;

a sink stage coupled to the first output, the sink stage comprising:

a sink transistor having a control terminal coupled to the first output, a first conduction terminal coupled to a first power supply node, and a second conduction terminal, and a sink current mirror coupled to the second conduction terminal of the sink transistor and an output node;

a source stage coupled to the second output, the source stage comprising:

a source transistor having a control terminal coupled to the second output, a first conduction terminal coupled to a second power supply node, and a second conduction terminal, and a source current mirror coupled to the second conduction terminal of the source transistor and the output node.

15. The circuit of claim 14, further comprising a first feedback network coupled between the first output and the second input, a second feedback network coupled between the second output and the second input.

16. The circuit of claim 15, further comprising a third feedback network coupled between the output node and the second input.

17. A circuit, comprising:

a differential input stage including a first input coupled to receive a reference signal, a second input coupled to receive a feedback signal, and a tail;

at least one gain stage coupled to the differential input stage;

a differential output stage having first and second outputs and comprising:

first and second voltage drop circuits, the first voltage drop circuit comprising a diode coupled transistor coupled in series with a fixed current source, a first output stage transistor having a first conduction terminal coupled to the tail and to the first output, a second conduction terminal coupled to the at least one gain stage and to the second output, and a control terminal coupled to the first voltage drop circuit, and a second output stage transistor having a first conduction terminal coupled to the tail and to the first output, a second conduction terminal coupled to the at least one gain stage and to the second output, and a control terminal coupled to the second voltage drop circuit.

18. The circuit of claim 17, wherein the at least one gain stage comprises a first gain stage coupled to the differential input stage, and a second gain stage coupled to the first gain stage; wherein the differential input stage has a tail; and wherein the differential output stage is coupled between the tail and the second gain stage.

19. The circuit of claim 17, wherein the second voltage drop circuit comprises a diode coupled transistor coupled in series with a fixed current source.

20. A low dropout amplifier, comprising:

an error amplifier having first and second inputs coupled to a reference signal and a feedback signal, respectively, and configured to generate first and second error signals at first and second outputs, respectively, the first and second error signals based upon a difference between the reference signal and the feedback signal;

a sink stage coupled to the first output and configured to generate a sink current based upon the first error signal;

a source stage coupled to the second output and configured to generate a source current based upon the second error signal; and an output node coupled to receive the sink and source currents;

wherein the sink stage comprises:

a transistor having a control terminal coupled to the first output to receive the first error signal, a first conduction terminal coupled to a first power supply node, and a second conduction terminal, the transistor configured to generate a current from its second conduction terminal based upon the first error signal; and a sink current mirror coupled to the second conduction terminal of the transistor and the output node, and configured to mirror the current as the sink current applied to the output node;

wherein the source stage comprises:

a transistor having a control terminal coupled to the second output to receive the second error signal, a first conduction terminal coupled to a second power supply node, and a second conduction terminal, the transistor configured to generate a current from its second conduction terminal based upon the second error signal; and a source current mirror coupled to the second conduction terminal of the transistor and the output node, and configured to mirror the current to the output node as the source current; and a class AB amplifier stage coupled between the transistor of the sink stage and the sink current mirror, and between the transistor of the source stage and the source current mirror.

21. The low dropout amplifier of claim 20, wherein the class AB amplifier stage comprises:

first and second resistors coupled in series between the second conduction terminal of the transistor of the source stage and the first conduction terminal of the transistor of the sink stage;

third and fourth resistors coupled in series between the first conduction terminal of the transistor of the source stage and the second conduction terminal of the transistor of the sink stage;

a first transistor has a first conduction terminal coupled to a first current source, a second conduction terminal coupled to a first node, and a control terminal coupled to the first conduction terminal of the first transistor;

a second transistor has a first conduction terminal coupled to a cascode, a second conduction terminal coupled to a second node, and a control terminal coupled to the first conduction terminal of the first transistor;

a third transistor having a first conduction terminal coupled to the first node, a second conduction terminal coupled to a second current source, and a control terminal coupled to the second conduction terminal of the third transistor; and a fourth transistor having a first conduction terminal coupled to the second node, a second conduction terminal coupled to the sink current mirror, and a control terminal coupled to the second conduction terminal of the third transistor.

* * * * *